United States Patent [19]

Ammenheuser et al.

[11] Patent Number: 4,547,064

[45] Date of Patent: Oct. 15, 1985

[54] ELECTROSTATOGRAPHIC REPRODUCING APPARATUS

[75] Inventors: Herbert H. Ammenheuser, Henrietta; Joseph Fantuzzo, Webster, both of N.Y.

[73] Assignee: Xerox Corporation, Stamford, Conn.

[21] Appl. No.: 645,961

[22] Filed: Aug. 31, 1984

[51] Int. Cl.[4] ..... G03G 21/00

[52] U.S. Cl. ..... 355/15; 355/3 DD; 15/1.5 R

[58] Field of Search ..... 355/3 DD, 15; 118/652, 118/653, 656-658; 222/DIG. 1; 430/122; 15/1.5 R, 256.5

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 3,918,808 | 11/1975 | Narita | 355/15 |
| 3,947,106 | 3/1976 | Hamaguchi et al. | 355/1 |
| 3,977,777 | 8/1976 | Tanaka et al. | 355/1 |
| 4,087,170 | 5/1978 | Sawaoka et al. | 355/3 CH |
| 4,240,723 | 12/1980 | Forgo | 355/3 DD |
| 4,265,998 | 5/1981 | Barkley | 430/125 |
| 4,320,958 | 3/1982 | Fantuzzo | 355/3 DD |
| 4,372,669 | 2/1983 | Fantuzzo et al. | 355/3 R |
| 4,386,844 | 6/1983 | Kamogawa et al. | 355/15 |
| 4,451,133 | 5/1984 | Kopp et al. | 355/15 X |
| 4,465,356 | 8/1984 | Joseph et al. | 355/3 DD |
| 4,494,863 | 1/1985 | Laing | 355/15 |

FOREIGN PATENT DOCUMENTS

| | | | |
|---|---|---|---|
| 2522466 | 12/1975 | Fed. Rep. of Germany . | |
| 57-86875 | 5/1982 | Japan | 355/3 DD |

OTHER PUBLICATIONS

"Magnetic Brush Unit With Magnetic Conveyor", W. D. Freeman et al., IBM Technical Disclosure Bull., vol. 15, No. 4, Sep. '72, p. 1251.

*Primary Examiner*—A. T. Grimley
*Assistant Examiner*—Carl Romano

[57] ABSTRACT

A modular developer and cleaner housing for use in an electrostatographic reproducing apparatus of the type wherein a recyclable imaging member completes two cycles for each copy produced, includes a development portion and a cleaning portion with the development portion including means for continuous development engagement with an imaging surface, and the cleaning portion including a cleaning blade for cleaning an imaging surface and including means for alternately positioning the cleaning blade into and out of cleaning engagement with the imaging surface. The cleaning portion further includes a used toner collection enclosure to collect used toner cleaned from the imaging surface by the cleaning blade which is separated from the development portion of the housing whereby toner cleaned from the imaging surface is collected separately from the developer.

14 Claims, 6 Drawing Figures

ELECTROSTATOGRAPHIC REPRODUCING APPARATUS

BACKGROUND OF THE INVENTION

This invention relates generally to an electrostatographic reproducing machine for reproducing an original document on a copy sheet. More particularly, the reproducing machine of the present invention includes a combined charging-transferring station, a combined exposing-discharging station, and a combined developing-cleaning station.

Generally, in the process of electrophotographic printing, a photoconductive member is charged to a substantially uniform potential to sensitize the surface thereof. The charged portion of the photoconductive surface is exposed to a light image of an original document being reproduced. This records an electrostaic latent image on the photoconductive member corresponding to the informational areas contained within the original document. After recording the electrostatic latent image on the photoconductive member, the latent image is developed by bringing a developer material comprising carrier granules having toner particles adhering triboelectrically thereto into contact therewith. The toner particles are attracted from the carrier granules to the electrostatic latent image to form a toner powder image which is subsequently transferred to a copy sheet. Thereafter, the toner powder image is permanently affixed to the copy sheet in image configuration.

Generally, the various stations for charging, exposing, developing, transferring, cleaning, and discharging are separate units disposed about the photoconductive member. The complexity and associate cost of the reproducing machine may be significantly reduced if the various separate units are combined to perform dual functions. Hereinbefore, various attempts have been made to achieve the foregoing. In particular, various combination units have been devised for electrophotographic printing machine employing photoconductive drums.

PRIOR ART

U.S. Pat. No. 3,637,306 (Cooper) discloses an electrophotographic printing machine employing a combined developing cleaning unit which is operable to perform either function at the proper time during the copying sequence. This unit is a magnetic brush developer unit that serves both as a developer and cleaner in the system.

U.S. Pat. No. 3,647,293 (Queener) also describes a combined developing cleaning unit wherein the magnetic brush developer unit serves both as developer and cleaner in the system. In the developing mode, toner particles are attracted from the carrier granules of the unit to the photoconductive layer. When used in the cleaning mode, the brush rotates and the developer mixture is brushed against the photoconductive layer to scavange residual toner particles remaining thereon.

U.S. Pat. No. 4,087,173 (Sawaoka et al.) discloses an electrostatic copying machine having a rotatable photoconductive drum. The machine includes charge/transfer, exposure/discharge, and developer/clean units. During the first rotation of the drum, charge, exposure and development are affected. In the second rotation, transfer discharge and cleaning are achieved. The charge/transfer unit performs the functions of charging and transferring with the exposure discharge unit exposing and discharging and the development/clean unit performing development and cleaning.

U.S. Pat. No. 4,372,669 (Fantuzzo et al.) describes a similar type of apparatus wherein instead of a photoconductive drum being used for the imaging surface, a photoconductive belt is arranged to move in a recirculating path.

While all the above described machine concepts enable the economy of manufacturing by combining two functions in the same functional apparatus around an imaging surface, they all suffer from the same difficulty in that they use the same mechanism for both the development and cleaning functions. As a result, residual toner on the imaging surface cleaned from the imaging surface during the cleaning cycle falls back into the development zone and mixes with the new toner added to the development zone. The vast majority of the residual toner cleaned from the imaging surface is toner that was not transferred to the receiving or copy substrate because it was charged to the wrong polarity. Thus, for example, if the photoconductive insulating layer is negatively charged, positively charged toner will develop the image which should be subsequently transferred to the copy paper. The residual toner remaining on the imaging surface is negatively charged. This negatively charged toner mixes with the new toner which is desired to be positively charged and eventually leads to a reduction in the carrier life. Furthermore because there is wrong sign toner in the developer which on a cycling basis increases, a larger powder cloud of toner and dirt may be generated. This is as a result of the wrong sign toner not being attracted to the carrier therefore adding to dirt and subsequent machine contamination and subsequent background on copies. Furthermore with the residual toner that is cleaned from the imaging surface being returned to the development sump, other debris such as paper debris including clay and paper fibers may come into the development sump thereby tending to foul the development system.

SUMMARY OF THE INVENTION

In accordance with the principal aspect of the present invention there is provided a modular developer cleaning housing for use in electrostatographic reproducing apparatus of the type wherein a recyclable imaging member completes two cycles for each copy produced, said modular housing comprising a development portion and a cleaning portion, the development portion including development means for continuous developing engagement with the cyclable imaging surface, said cleaning portion including a cleaning blade for cleaning an imaging surface and including means for alternately positioning said cleaning blade into and out of cleaning engagement with the imaging surface, said cleaning portion further including a used toner collection enclosure to collect used toner cleaned from the imaging surface by the cleaning blade and being separate from the development portion of said housing whereby toner cleaned from the imaging surface may be collected separately from the development portion and not returned directly thereto.

In a further aspect of the present invention, the modular development cleaning assembly is used with electrostatographic reproducing apparatus for reproducing original input information onto a copy substrate which includes means for forming an electrostatic latent image on a cyclable imaging surface, means to develop said electrostatic latent image with toner particles, means to transfer said toner image to a copy substrate, means to clean said imaging surface of said residual toner and means to neutralize said electrostatic latent image prior to producing the next copy.

In a further aspect of the present invention, the cleaning blade is pivotally mounted across the width of the imaging surface and includes a solenoid connected by a linkage to said cleaning blade to alternately position said cleaning blade into and out of cleaning engagement with the imaging surface.

In a further aspect of the present invention, a development means comprises a magnetic brush including at least one rotatably mounted tubular member and a magnetic member mounted stationarily interiorly of and spaced from said tubular member.

In a further aspect of the present invention, the apparatus includes toner collection and dispensing trough, which comprises an auger to replenish toner from a toner supply, a carrier catch portion to receive a portion of the carrier transported by the magnetic brush through the development zone and a dispensing mixing auger to mix said received portion of the carrier with newly supplied toner and dispense thereby formed developer to a development sump.

In a further aspect of the present invention, the toner collection enclosure of the modular developer and cleaner housing has a spillover opening at its top in communication with the top of the developer sump and the capacity of said toner collection enclosure up to said spillover opening is equal to the amount of toner collected when carrier in the development portion has reached its maximum functional life.

Accordingly it is an object of the present invention to provide a modular development cleaning assembly for electrostatographic reproducing apparatus which cleans residual toner from the imaging surface in the second cycle of a two cycle imaging process and collects the cleaned residual toner separately from the main developer sump.

It is a further object of the present invention to provide compact, inexpensive combination development cleaning subassembly for electrostatographic reproducing apparatus.

It is a further object of the present invention to provide a combination development cleaning assembly wherein toner and debris contamination of the machine is minimized.

DESCRIPTION OF THE PREFERRED EMBODIMENT

Figure 1:
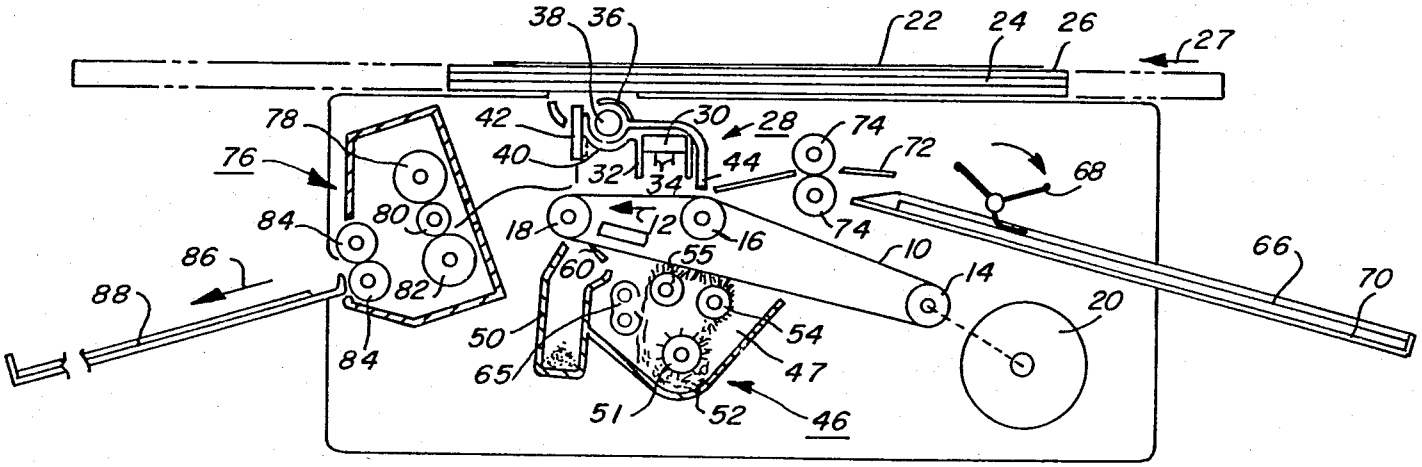
FIG. 1 is a schematic representation in cross section of an automatic electrostatographic reproducing machine with the modular development cleaning housing according to the present invention.

The invention will now be described with reference to a preferred embodiment of the modular developer cleaning housing in an electrostatographic reproducing apparatus employing same.

The drawings schematically depict the various components of the electrostatographic reproducing machine incorporating the features of the present invention therein. In the drawings and specification like reference numerals have been used throughout to designate identical elements. It will become evident from the following discussion that these features are equally suited for use in a wide variety of electrostatographic reproducing machines and are not necessarily limited in their applications to particular embodiment depicted herein.

Referring now to FIG. 1, as shown in the drawing, the electrophotographic printing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance successive portions of the photoconductive surface through the various processing stations disposed about the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal direction, as indicated by arrow 27. Belt 10 is driven at a linear velocity substantially equal to the linear velocity of platen 24. Belt 10 moves in a recirculating path. In order to reproduce a copy of an original document, belt 10 performs two complete cycles of movement through the recirculating path.

During the first cycle, belt 10 advances a portion of the photoconductive surfce initially beneath a charging-transferring unit, indicated generally by the reference numeral 28. Charging-transferring unit 28 includes a corona generating device 30 which charges the photoconductive surface of belt 10 to a relatively high substantially uniform potential. Corona generating device 30 includes a U-shaped shield 32 having an open end opposed from the photoconductive surface of belt 10. Two rows of substantially equally spaced pins 34 extend outwardly from shield 32 toward the open end thereof opposed from the photoconductive surface of belt 10.

Next, belt 10 advances the charged portion of photoconductive surface 12 beneath a combined exposing-discharging unit, indicated generally by the reference numeral 36. Combined exposing-discharging unit 36 includes a light source 38, preferably an elongated tungsten lamp. Light source 38 is disposed stationarily beneath platen 24. An opaque shield 40 surrounds light source 38. Shield 40 has a slit therein so that the light rays from light source 38 are projected onto original document 22 disposed facedown on transparent platen 24. As platen 24 moves in the direction of arrow 27, successive incremental portions of original document 22 are illuminated. Light rays reflected from original document 22 are transmitted through a bundle of image transmitting fibers, indicated generally by the reference numeral 42. Image transmitting fibers 42 are bundled gradient index optical fibers. U.S. Pat. No. 3,658,407 issued to Kitano et al. in 1972 describes a light conducting fiber made of glass or synthetic resin which has a refractive index distribution in cross section thereof that varies consecutively and parabolically outwardly from a center portion thereof. Each fiber acts as a focusing lens to transmit part of an image placed at, or near, one end thereof. An assembly of fibers, in a staggered two-row array, transmits and focuses a complete image of the object. The fiber lenses are produced under the tradename "SELFOC"; the mark is registered in Japan and owned by Nippon Sheet Glass Company, Limited. These gradient index lens arrays are used as a replacement for conventional optical systems in electrophotographic printing machines, such as being disclosed in U.S. Pat. No. 3,947,106 issued to Hamaguchi et al., in 1976 and U.S. Pat. No. 3,977,777 issued to Tanaka et al. in 1976. The relevant portions of the foregoing patents are hereby incorporated into the present disclosure. The light rays reflected from the original document are transmitted through the image transmitting fibers onto the charged portions of the photoconductive surface of belt 10 to selectively dissipate the charge thereon. This records an electrostatic latent image on the photoconductive surface of belt 10 which corresponds to the informational areas contained within original document 22. Combined exposing-discharging unit 36 also includes a light transmitting glass fiber optical tube 44. One end of optical tube 44 is disposed closely adjacent to light source 38. The other end of optical tube 44 is positioned closely adjacent to the photoconductive surface of belt 10 prior to combined charging-tranferring unit 28 in the direction of movement of belt 10, as indicated by arrow 12.

Figure 2:
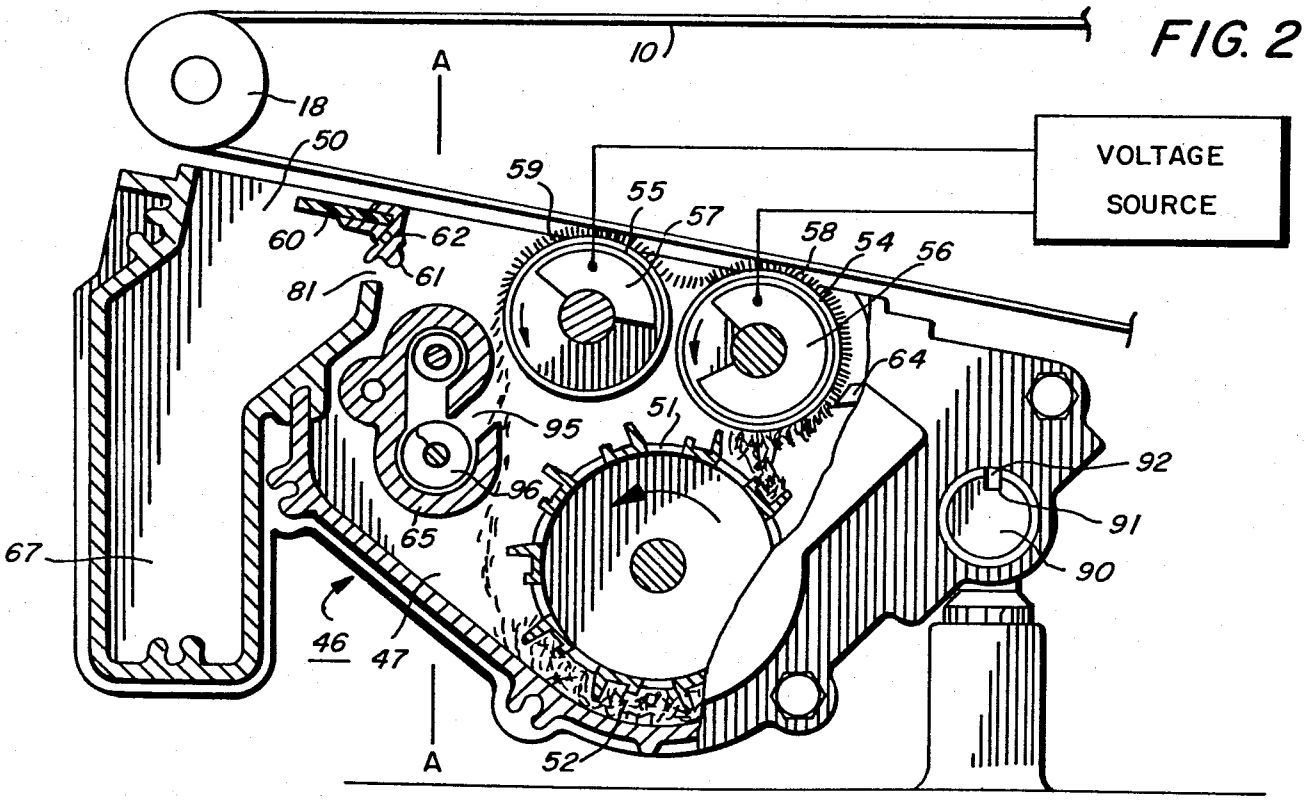
FIG. 2 is an enlarged cross section through the center taken from the front of the development cleaning assembly.
Figure 3:
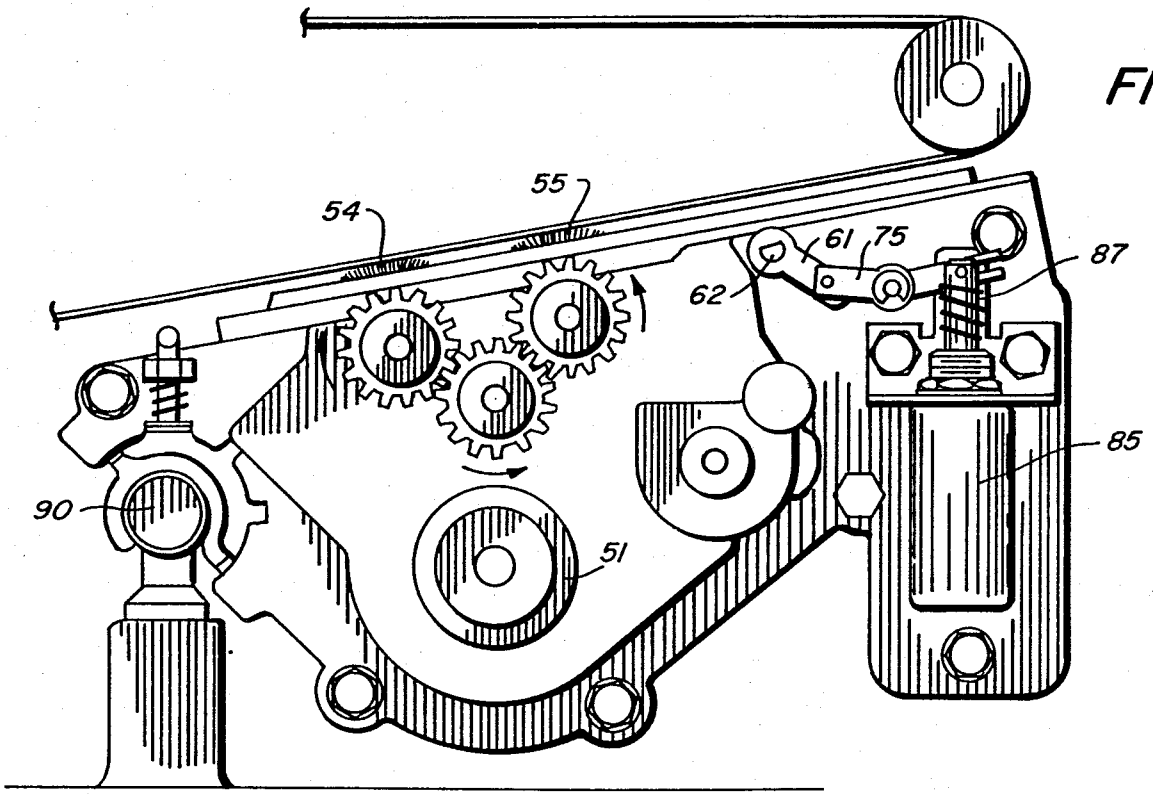
FIG. 3 is an enlarged view from the rear illustrating the blade actuating mechanism.

Thereafter and with additional reference to FIG. 2, belt 10 advances the electrostatic latent image recorded on the photoconductive surface to a combined developing cleaning unit indicated generally by the reference numeral 46. Combined developer cleaning unit 46 includes a development portion 47 and a cleaning portion 50. The development portion 47 includes a pair of developer rolls 54 and 55 each comprised of an elongated cylindrical magnet 56 and 57 respectively, mounted interiorly of tubular sleeve members 58 and 59 respectively. Tubulars sleeve members rotate in a counterclockwise direction as shown by the arrow. Developer is conveyed from the developer sump 52 by a paddle wheel cross mixer 51 rotating counterclockwise. The paddle wheel cross mixer has a plurality of buckets which advance the developer material comprising magnetic carrier granules having toner particles adhered triboelectrically thereto upward toward the developer rollers 54 and 55. The first developer roller 54 attracts a developer material thereto and as the tubular sleeve member 58 rotates in a counterclockwise direction the developer material is transported into contact with the latent image and toner particles are attracted from the carrier granules onto the electrostatic latent image. In this way, a toner powder image is formed on the photoconductive surface of the belt 10. A voltage source is electrically connected to tubular member 58 and 59 so as to electrically bias the tubular member to a potential ranging from about 50 volts to about 500 volts. The specific selected voltage level depends upon the potential level of the latent image and that of the background areas. During development, the bias voltage is intermediate that of the background and the latent image. Preferably the tubular sleeve members 58 and 59 are made from non-magnetic materials such as aluminum having the exterior circumferential surface thereof roughened. Magnetic members 56 and 57 are preferably made from barium ferrite having a plurality of magnetic poles in place thereon. A metering blade 64 may be employed to regulate the quantity of developer material being transported into contact with electrostatic latent image recorded on the photoconductive surface of the belt 10. Following development, the toner depleted developer is transported to the exit portion of the development sleeve 59 and tends to fall by gravity back into the developer sump 52. As will be described in greater detail hereinafter a portion of the carrier particles are collected in the toner blending sump, generally indicated as 65. During the entire development operation in the first cycle of producing a copy in the electrostatographic reproducing apparatus, the cleaning blade 60 pivotally mounted on cleaning blade holder 61 is positioned out of contact with the imaging surface in a manner to be described hereinafter in greater detail, and therefore provides no contact or cleaning function with the photoconductive belt.

After the toner powder image is formed on the photoconductive surface of belt 10, belt 10 returns the toner powder image to the combined charging-transferring unit 28 for the start of the second cycle. At this time, a copy sheet 66 is advanced by a sheet feeder 68 to combined charging-transferring unit 28. The copy sheet is advanced in a timed sequence so as to be in synchronism with the toner powder image formed on the photoconductive surface of belt 10. In this way, one side of the copy sheet contacts the toner powder image at combined charging-transferring unit 28. Preferably, sheet feeder 68 includes a rotatably mounted cylinder having a plurality of spaced, flexible vanes extending outwardly therefrom. The free end of each vane successively engages the uppermost sheet 66 of stack 70. As feeder 68 rotates, sheet 66 moves into chute 72. Registration rollers 74 advances sheet 66, in synchronism with the toner powder image on the photoconductive surface of belt 10, to combined charging-transferring unit 28.

Corona generating device 30 of combined charging-transferring unit 28 sprays ions onto the backside of the copy sheet. This attracts the toner powder image from the photoconductive surface of belt 10 to the sheet. After transfer, the sheet continues to move with belt 10 until the beam strength thereof causes it to strip therefrom as belt 10 passes around roller 18. As the sheet separates from belt 10, it advances to a fuser assembly, indicated generally by the referenced numeral 76. Preferably, fuser assembly 76 includes rollers 78, 80 and 82. The sheet passes between rollers 80 and 82 which apply pressure thereon to permanently affix the toner powder image to the copy sheet. Thereafter, exiting rollers 84 advance the sheet in the direction of arrow 86 onto catch tray 88 for subsequent removal from the printing machine by the operator.

Following transfer as the photoconductive belt advances the residual toner particles adhering to the photoconductive surface past the cleaning housing during the second cycle of the reproducing sequence, the cleaning blade 60 is positioned to engage the photoconductive belt in wiping contact to scrape the residual toner particles off the photoconductive belt whereafter the particles fall by gravity into the toner collection enclosure 67. The cleaning blade may be made out of any suitable material from those conventionally used in blade cleaning electrostatographic systems. The blade may be made from any suitable elastomeric material. Typically, a polyurethane blade is used. Since the residual toner material (including toner and debris) on the photoconductive belt 10 which is removed by the cleaning blade 60 falls directly into the toner collection enclosure, they are separately collected and are not added or returned to the development sump according to the techniques in the prior art. Accordingly, with continued reuse the developer in the developer sump remains substantially uncontaminated by toner of wrong sign as well as other debris which may be removed from the photoconductive belt 10 by the blade 60.

After residual toner particles have been cleaned from the photoconductive surface of belt 10, the residual charge thereon passes beneath combined exposing-discharging unit 36. At that time, a light shutter permits light rays from light source 38 to be transmitted through fiber optic tube 44 onto the photoconductive surface to remove any residual electrostatic charge remaining thereon prior to the charging thereof for the next successive cycle. During the first cycle, the shutter prevents light rays from light source 58 from being transmitted through tube 44.

With continued reference to FIG. 2 and additional reference to FIGS. 3, 4, 4*a*, 4*b*, 5 and, the combination development cleaning housing will now be discussed in greate detail.

Figure 4A:
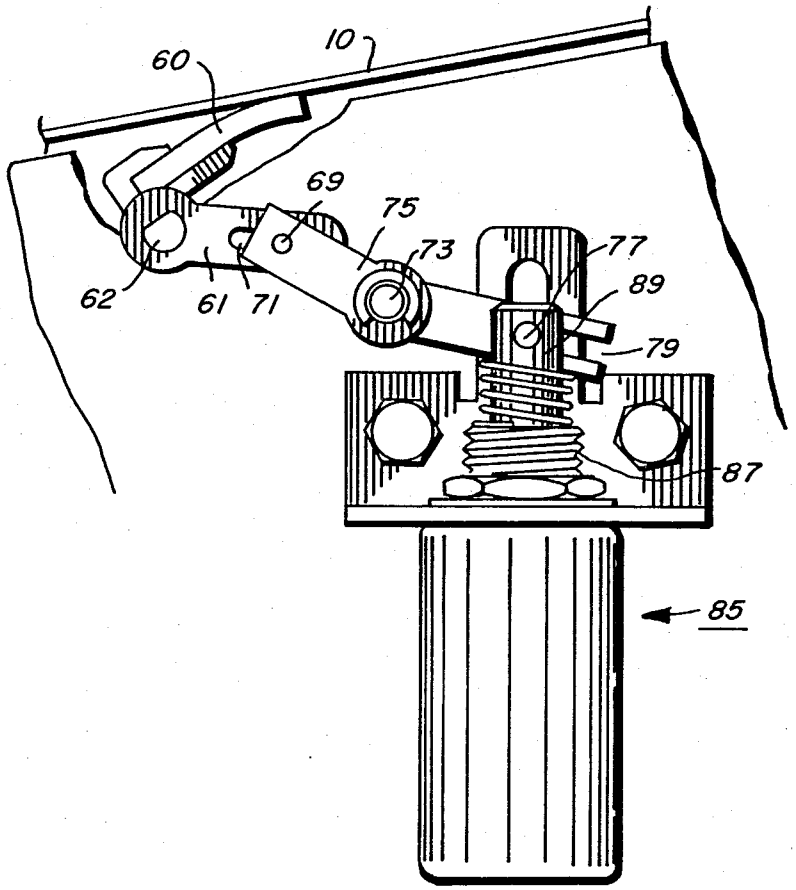
FIGS. 4 and 4*b* illustrate the cleaning blade in and out of position based on activation or inactivation of the solenoid.
Figure 4B:
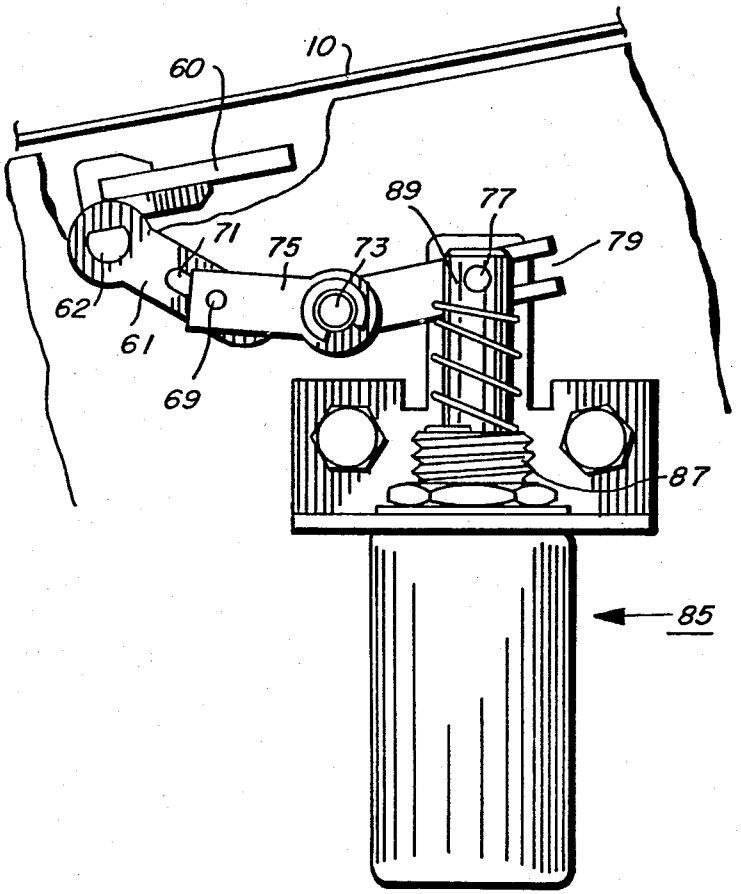

The cleaning blade 60 is attached to cleaning blade holder 61 which in turn is pivoted about cleaning blade holder shaft 62. The opposite end of the cleaning blade holder having a slot 71 therein for engagement with a pin 69 in the end of solenoid linkage 75 which is pivotally mounted about linkage shaft 73. The other end of the solenoid linkage has a slot 79 in engagement with pin 77 attached to the end of plunger 89 of solenoid mechanism 85. When the solenoid is activated the plunger 89 is withdrawn into the body of the solenoid thereby urging the cleaning blade 60 into cleaning engagement with the photoreceptor belt, as illustrated in FIG. 4*a*. When the solenoid is deactivated, the plunger 89 is free to be withdrawn from solenoid coil and the spring 87 urges the solenoid linkage 75 upwardly thereby retracting the cleaning blade 60 from engagement with the photoreceptor belt 10. As may be observed from FIG. 4*a*, when the solenoid is activated the cleaning blade is in pressure engagement against the photoreceptor belt 10 forming an angle therewith of about 25°.

With continued reference to FIG. 2, cleaning portion 50 of the developer cleaning housing 46 includes a toner collection enclosure 67 having a spillover opening 81 at its top which is in communication with the top of the developer sump 52. The capacity of the toner collection enclosure 67 if desired may be designed to contain an amount of residual toner collected up to the toner spillover opening of the top that is about equal to the amount of toner collected when the carrier in the developer in the developing portion 47 has reached its maximum functional lifeand filure occurs. By developer failure we mean that period of usage after which the triboelectric relationship between the carrier and toner deteriorates as a result of carrier becoming coated with toner producing inadequately charged toner and therefore poor copies. When the toner level in the toner collection enclosure 67 reaches the level of the spillover opening 81, the toner will be spilled back into the developing portion 47 of the developer/cleaning housing 46 at which time it will tend to mix with the developer in developer housing and since it is of the wrong sign toner will tend to foul or otherwise contaminate the development process which may be perceived by the operator by poor copy quality exhibiting increased background. Having observed difficulties in copy quality, the operator is then on notice that the developer charge in the development housing portion 47 should be changed and that the collected spent toner in the toner collection enclosure removed and disposed of.

With continued reference to FIG. 2, the whole developer cleaning housing 47 may be arranged to be slideably mounted from the front onto shaft 90 which has a groove 91 formed in the shaft to match with a similar portion 92 on the developer cleaner housing to lift the developer cleaning housing into its operational position at the end of the path of insertion onto the shaft 90. The groove 91 and mating portion 92 in the developer cleaner housing function very much like a cam surface so that upon removal of the modular developer cleaner housing, it automatically initially drops away from the photoconductive belt so that the belt is not scrapped by the developer rolls.

With continued reference to FIG. 2 as well as additional reference to FIG. 5, an additional feature of the developer portion of the developer cleaning housing as well as the means for supplying toner will be described. In the development processes indicated above, the developer charge including carrier particles and toner particles is placed in the developer sump 52. The cross mixer and paddle wheel 51 act to cross mix carrier and the toner in the sump as well as mix in new toner which is supplied in the manner to be described hereinafter. Furthermore this mixing action generates the proper triboelectric relationship between the toner and the carrier and as the cross mixer rotates in a counterclockwise direction, delivers the developer mixture of carrier and toner to the first of the magnetic brush developer rolls 54. The rotatable sleeve 58 brings the developer from the paddle wheel cross mixer 51 into the development zone at the top and is transported through the development zone with the developer jumping across to the second developer sleeve 59. At this point the developer splits with a major portion of it returning to the developer sump 52 and with a small amount falling into the opening 95 of the toner blending sump 65 where the carrier is mixed with freshly supplied toner and subsequently transported out of the toner blending sump back into the developer sump 52. The toner blending sump 65 contains rotatably mounted bottom auger 96 extending across the width of the developing portion 47 which at one end is in communication with a deposit zone 99 of toner metering auger 97 which supplies toner from the toner bottle 98 to the developer sump 52.

Figure 5:
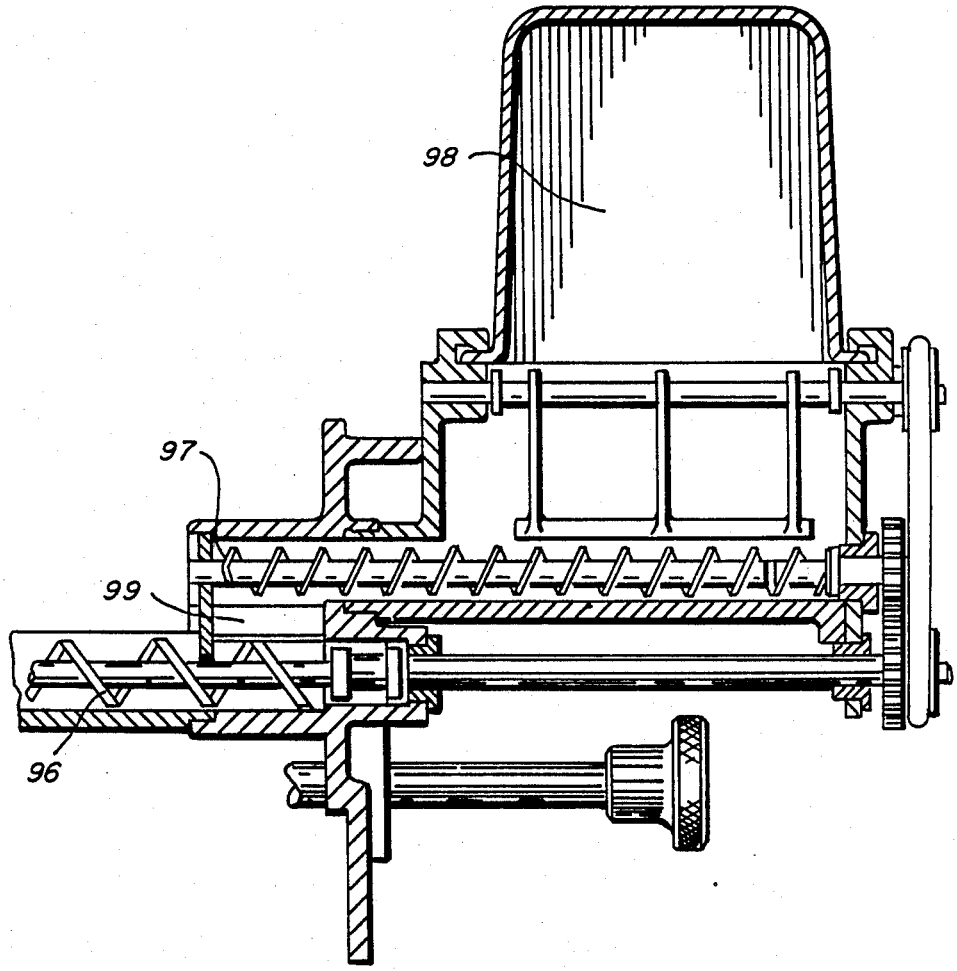
FIG. 5 is a section taken along the line AA of FIG. 2 showing the toner bottle and auger assembly structure.

As illustrated with continued reference to FIG. 5 and FIG. 2, toner contained within toner bottle 98 may fall by gravity onto toner metering auger 97 which transports it to its deposit zone 99 whereupon the toner is transported by bottom auger 96 to the toner blending sump 65. In the toner blending sump the freshly supplied toner is premixed and precharged by contact with the carrier entering the toner blending sump through opening 95. When the toner blending sump is filled, the partially premixed and precharged developer is discharged by auger 96 into the developer sump 52 whereupon it will be mixed with the supply of mixed and charged developer already in the sump. The toner blending sump together with the bottom auger which contain some toner depleted carrier collected from the development zone facilitates the transport of the toner into the developer sump 52 since it is much easier to transport carrier mixed with toner than new toner.

It may therefore be readily appreciated by reference to the foregoing description when taken with the drawings that the invention provides a modular combination developing cleaning housing for use in an electrostatographic reproducing apparatus of the type wherein a recyclable imaging member completes two cycles for each copy produced and wherein residual toner cleaned from the imaging surface is not returned to the developer chamber. In this way, in addition to the toner being collected, paper debris such as clay is removed from the developer chamber thereby minimizing contamination of the developer chamber and also minimizing contamination of the machine by minimizing the size of the powder cloud of wrong size toner formed. Moreover, the background on the copies produced from such a process is substantially reduced. Furthermore with the provision of a spillover opening in the top of the toner collection enclosure together with the design of the toner collection enclosure capacity to be the size to collect residual toner at about the time that the carrier in the developer portion has reached its useful functional life, the operator is automatically advised of the necessity for changing the developer charge in the developer portion. In addition the illustrated and described toner blending sump provides a convenient means for providing premixing and precharging of freshly added toner to the developer mix.

The disclosures of the patents referred to herein are hereby specifically and totally incorporated herein by reference.

While the invention has been described with reference to specific embodiments thereof, it will be apparent to those skilled in the art that many alternatives, modifications and variations may be made. For example, while the cleaning blade has been shown to be actuated through the use of a solenoid mechanism it will be understood that other alternative mechanical camming arrangements could be used. Furthermore while the invention has also been illustrated for use with a photoconductive belt, it could equally well be used with a photoconductive drum with a cleaner developer housing shaped to suitably interact with the drum. In addition, while the invention has been illustrated with regard to a magnetic brush development apparatus it will be understood that virtually any type of developing apparatus may be employed. Further while the invention has been illustrated for use with a copier, it will be understood that it could equally be applicable to use in a printer application. Accordingly it is intended to embrace all such alternatives and modifications as may fall within the spirit and scope of the appended claims.

What is claimed is:

1. An electrostatographic reproducing apparatus for reproducing original input information onto a copy substrate including means for forming an electrostatic latent image on a cyclable imaging surface, means to develop said electrostatic latent image with toner particles, means to transfer said toner image to a copy substrate, means to clean said imaging surface of residual toner and means to neutralize said electrostatic latent image prior to producing the next copy;

said development and cleaning means comprising a modular housing assembly positioned for both development and cleaning engagement with said imaging surface, said modular assembly including development means in continuous developing engagement with said imaging surface, and a cleaning blade for cleaning said imaging surface, and including means to alternately position said cleaning blade into and out of cleaning engagement with said imaging surface, said development and cleaning housing further including a used toner collection enclosure to collect used toner cleaned from the imaging surface by the cleaning blade when said blade is in engagement with said imaging surface, said toner collection enclosure being separate from the development portion of said housing whereby said development and cleaning operations are performed on said imaging surface at different times and said cleaned toner is collected separately from the development supply of toner.

2. The apparatus according to claim 1, wherein said cleaning blade is pivotally mounted across the width of said imaging surface and said means to alternately position said cleaning blade into and out of cleaning engagement with said imaging surface comprises a solenoid connected by a linkage to said pivotally mounted cleaning blade.

3. The apparatus according to claim 1, wherein said cyclable imaging surface completes two cycles for each copy produced and wherein said development and cleaning housing develops the electrostatic latent image on the first pass through said housing while said blade cleaner is positioned out of contact with said imaging surface and wherein the developer cleaner housing cleans said imaging surface on the second pass through said housing while said blade cleaner is positioned in contact with said imaging surface.

4. The apparatus of claim 1, wherein said means to form an electrostatic latent image on said imaging surface comprises means to uniformly charge said imaging surface and means to expose said imaging surface to an image to be reproduced.

5. The apparatus of claim 4, including an imaging platen and wherein said image to be reproduced is an original document placed on said imaging platen.

6. The apparatus of claim 1, wherein said cyclable imaging surface comprises an endless belt with a photoconductive layer.

7. The apparatus of claim 1, wherein said development means comprises a magnetic brush including at least one rotatably mounted tubular member and a magnetic member mounted stationarily interiorly of and spaced from said tubular member.

8. The apparatus of claim 7, wherein said development means includes a toner collection and dispensing trough, said trough comprising an auger to replenish toner from a toner supply, a carrier catch portion to receive a portion of the carrier transported by said magnetic brush through the development zone and a dispensing mixing auger to mix said received portion of the carrier with newly supplied toner and dispense the newly formed developer to a development sump.

9. The apparatus of claim 1, wherein said used toner collection enclosure has a spillover opening at its top in communication with the top of the developer sump and the capacity of said toner collection enclosure up to said spillover opening is about equal to the amount of toner collected when the carrier in the developer in the development means has reached its maximum functional life.

10. A modular developer and cleaner housing for use in an electrostatographic reproducing apparatus of the type wherein a recyclable imaging member completes two cycles for each copy produced, said modular housing comprising a development portion and a cleaning portion, said development portion including development means for continuous developing engagement with an imaging surface, said cleaning portion including a cleaning blade for cleaning an imaging surface and including means for alternatively positioning said cleaning blade into and out of cleaning engagement with an imaging surface, said cleaning portion including a used toner collection enclosure to collect used toner cleaned from the imaging surface by the cleaning blade and being separate from the development housing whereby toner cleaned from the imaging surface may be collected separately from the development portion and not returned directly thereto.

11. The apparatus according to claim 10, wherein said cleaning blade is pivotally mounted in said cleaning portion and includes means to alternatively position said cleaning blade into and out of cleaning engagement with an imaging surface which comprises a solenoid connected by a linkage to said pivotally mounted cleaning blade.

12. The apparatus according to claim 10, wherein said development portion comprises a magnetic brush including at least one rotatably mounted tubular member and a magnetic member mounted stationarily interiorly of and spaced from said tubular member.

13. The apparatus according to claim 12, wherein said development portion includes a toner collection and a dispensing trough, said trough comprising an auger to replenish toner from a toner supply, a carrier catch portion to receive a portion of the carrier transported by said magnetic brush through a development zone and a dispensing mixing auger to mix and receive said portion of the carrier with newly supplied toner and dispense thereby formed developer to the development zone.

14. The apparatus according to claim 11, wherein said used toner collection enclosure has a spillover opening at its top in communication with the top of the developer sump and the capacity of said toner collection enclosure up to said spillover opening is about equal to the amount of toner collected when the carrier in the developer in the development means has reached its maximum functional life.

* * * * *